US010724317B2

(12) United States Patent
Dusterhoft et al.

(10) Patent No.: US 10,724,317 B2
(45) Date of Patent: Jul. 28, 2020

(54) SEALED CORE STORAGE AND TESTING DEVICE FOR A DOWNHOLE TOOL

(71) Applicant: Halliburton Energy Services, Inc., Houston, TX (US)

(72) Inventors: Ronald Glen Dusterhoft, Katy, TX (US); Philip D. Nguyen, Houston, TX (US); Shameem Siddiqui, Richmond, TX (US); Douglas Everett Wyatt, Aiken, SC (US)

(73) Assignee: Halliburton Energy Services, Inc., Houston, TX (US)

( * ) Notice: Subject to any disclaimer, the term of this patent is extended or adjusted under 35 U.S.C. 154(b) by 194 days.

(21) Appl. No.: 15/580,753

(22) PCT Filed: Jul. 10, 2015

(86) PCT No.: PCT/US2015/039989
§ 371 (c)(1),
(2) Date: Dec. 8, 2017

(87) PCT Pub. No.: WO2017/010977
PCT Pub. Date: Jan. 19, 2017

(65) Prior Publication Data

US 2018/0148988 A1 May 31, 2018

(51) Int. Cl.
*E21B 25/10* (2006.01)
*E21B 49/06* (2006.01)
(Continued)

(52) U.S. Cl.
CPC ..... *E21B 25/10* (2013.01); *E21B 25/02* (2013.01); *E21B 27/00* (2013.01); *E21B 49/06* (2013.01);
(Continued)

(58) Field of Classification Search
CPC ..... E21B 25/06; E21B 25/08; E21B 25/10; E21B 49/06
See application file for complete search history.

(56) References Cited

U.S. PATENT DOCUMENTS 3,092,192 A * 6/1963 Deely ..... E21B 25/10 175/253
4,354,558 A * 10/1982 Jageler ..... E21B 4/02 173/36
(Continued)

FOREIGN PATENT DOCUMENTS

CN 202119697 1/2012
CN 103728184 4/2014
(Continued)

OTHER PUBLICATIONS

Extended European Search Report for European Patent Application No. 15898428.6, dated Apr. 19, 2018; 8 pages.
(Continued)

*Primary Examiner* — Giovanna Wright
(74) *Attorney, Agent, or Firm* — Baker Botts L.L.P.

(57) ABSTRACT

A sealed core storage and testing device for a downhole tool is disclosed. The device includes an outer body, an internal sleeve in the outer body, an end cap coupled to the outer body and operable to move from an open position to a closed position, and a plurality of ports located on at least one of the other body or the end cap.

17 Claims, 7 Drawing Sheets

(51) Int. Cl.

| | |
|---|---|
| ***E21B 25/02*** | (2006.01) |
| ***E21B 27/00*** | (2006.01) |
| *E21B 10/02* | (2006.01) |
| *E21B 25/06* | (2006.01) |
| *E21B 49/08* | (2006.01) |

(52) U.S. Cl.
CPC ..... *E21B 10/02* (2013.01); *E21B 25/06* (2013.01); *E21B 49/08* (2013.01)

(56) References Cited

U.S. PATENT DOCUMENTS

| | | | | |
|---|---|---|---|---|
| 5,299,453 | A | 4/1994 | Sprunt et al. | |
| 5,325,723 | A | 7/1994 | Meadows et al. | |
| 5,360,074 | A | 11/1994 | Collee et al. | |
| 6,003,620 | A * | 12/1999 | Sharma | E21B 25/00 175/40 |
| 6,220,371 | B1 | 4/2001 | Sharma et al. | |
| 6,659,204 | B2 | 12/2003 | Aumann et al. | |
| 6,971,260 | B2 | 12/2005 | Potter | |
| 7,500,388 | B2 * | 3/2009 | Fujisawa | E21B 49/06 73/152.11 |
| 7,748,265 | B2 | 7/2010 | Reid et al. | |
| 8,122,976 | B2 | 2/2012 | Bartette et al. | |
| 8,356,510 | B2 | 1/2013 | Coenen | |
| 8,684,110 | B2 * | 4/2014 | Reid, Jr. | E21B 49/06 175/58 |
| 2005/0133267 | A1 | 6/2005 | Reid, Jr. et al. | |
| 2007/0137894 | A1 | 6/2007 | Fujisawa et al. | |
| 2010/0282515 | A1 | 11/2010 | Reid, Jr. et al. | |
| 2013/0037539 | A1 * | 2/2013 | Graterol | E21B 25/02 220/23.83 |
| 2013/0199847 | A1 | 8/2013 | Delmar et al. | |
| 2014/0090893 | A1 | 4/2014 | Reid et al. | |
| 2014/0209385 | A1 | 7/2014 | Reid, Jr. et al. | |
| 2014/0340082 | A1 | 11/2014 | Yang et al. | |
| 2014/0352421 | A1 | 12/2014 | Meadows | |
| 2014/0367086 | A1 * | 12/2014 | Arian | E21B 49/06 166/244.1 |
| 2015/0191985 | A1 * | 7/2015 | Berger | E21B 25/08 175/24 |
| 2017/0004650 | A1 * | 1/2017 | Caliskan | G06T 7/00 |

FOREIGN PATENT DOCUMENTS

| | | |
|---|---|---|
| EP | 1247936 | 10/2002 |
| GB | 2063963 | 6/1981 |
| GB | 2415718 | 1/2006 |
| GB | 2441888 | 3/2008 |
| WO | 2004/019029 | 3/2004 |
| WO | 2007/070748 | 6/2007 |
| WO | 2013/101695 | 7/2013 |
| WO | 2014/012781 | 9/2014 |

OTHER PUBLICATIONS

International Preliminary Report on Patentability for PCT Patent Application No. PCT/US2015/039989, dated Jan. 25, 2018; 12 pages.

International Search Report and Written Opinion for PCT Patent Application No. PCT/US2015/039989, dated Mar. 21, 2016; 17 pages.

Extended European Search Report for European Patent Application No. 19185174.0, dated Sep. 26, 2019; 9 pages.

* cited by examiner

SEALED CORE STORAGE AND TESTING DEVICE FOR A DOWNHOLE TOOL

RELATED APPLICATIONS

This application is a U.S. National Stage Application of International Application No. PCT/US2015/039989 filed Jul. 10, 2015, which designates the United States, and which is incorporated herein by reference in its entirety.

TECHNICAL FIELD

The present disclosure relates generally to coring tools, such as earth-boring core bits and core holders.

BACKGROUND

Various types of drilling tools including, but not limited to, rotary drill bits, reamers, core bits, under reamers, hole openers, stabilizers, and other downhole tools have been used to form boreholes in associated downhole formations. Examples of such rotary drill or core bits include, but are not limited to, fixed cutter drill or core bits, drag bits, hybrid bits, polycrystalline diamond compact (PDC), thermo-stable diamond (TSD), natural diamond, or diamond impregnated drill or core bits, and matrix or steel body drill or core bits associated with forming oil and gas wells extending through one or more downhole formations. Fixed cutter drill bits or core bits such as a PDC drill bit or core bit may include multiple blades that each include multiple cutting elements.

Hydrocarbons, such as oil and gas, often reside in various forms within subterranean geological formations. Often, a core bit is used to obtain representative samples of rock or core samples taken from a formation of interest. Analysis and study of core samples enable engineers and geologists to assess formation parameters such as the reservoir storage capacity, the flow potential of the rock that makes up the formation, the composition of the recoverable hydrocarbons or minerals that reside in the formation, and the irreducible water saturation level of the rock. For instance, information about the amount of fluid in the formation may be useful in the subsequent design and implementation of a well completion program that enables production of selected formations and zones that are determined to be economically attractive based on the data obtained from the core sample.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

The present disclosure describes a rotary sidewall coring device that captures core samples and stores the core samples in a pressurized core holder at downhole conditions, e.g., representative of the conditions where the core samples were taken. The core holder includes a variety of ports, valves, strain gauges, and sensors that enable testing and analysis of the core sample. When the core holder is brought to the surface, the pressurized core holder can be transported to a laboratory and testing and analysis may be performed on the core sample without altering the downhole conditions of the core sample. Thus the use of the core holder may improve the analysis of the core sample to provide more accurate information about a reservoir and the subterranean formation from which the core sample was cut. For example, the use of the core holder may allow high resolution imaging and measurement of the core sample under original reservoir pressure conditions and at different stages of pressure depletion. Additionally, using the core holder may allow a more accurate analysis of the volumes, composition, and properties of fluids and/or gases within the core sample as a function of pressure and temperature. That analysis may provide the basis for simulation of actual downhole conditions during production. Further, the fluids and/or pressures contained within the core sample may be released under controlled conditions to allow for analysis of the stages of pressure depletion and the impact of pressure depletion on the core sample and the associated fluids initially contained in the core sample. The present disclosure and its advantages are best understood by referring to FIGS. 1 through 5, where like numbers are used to indicate like and corresponding parts.

Figure 1:
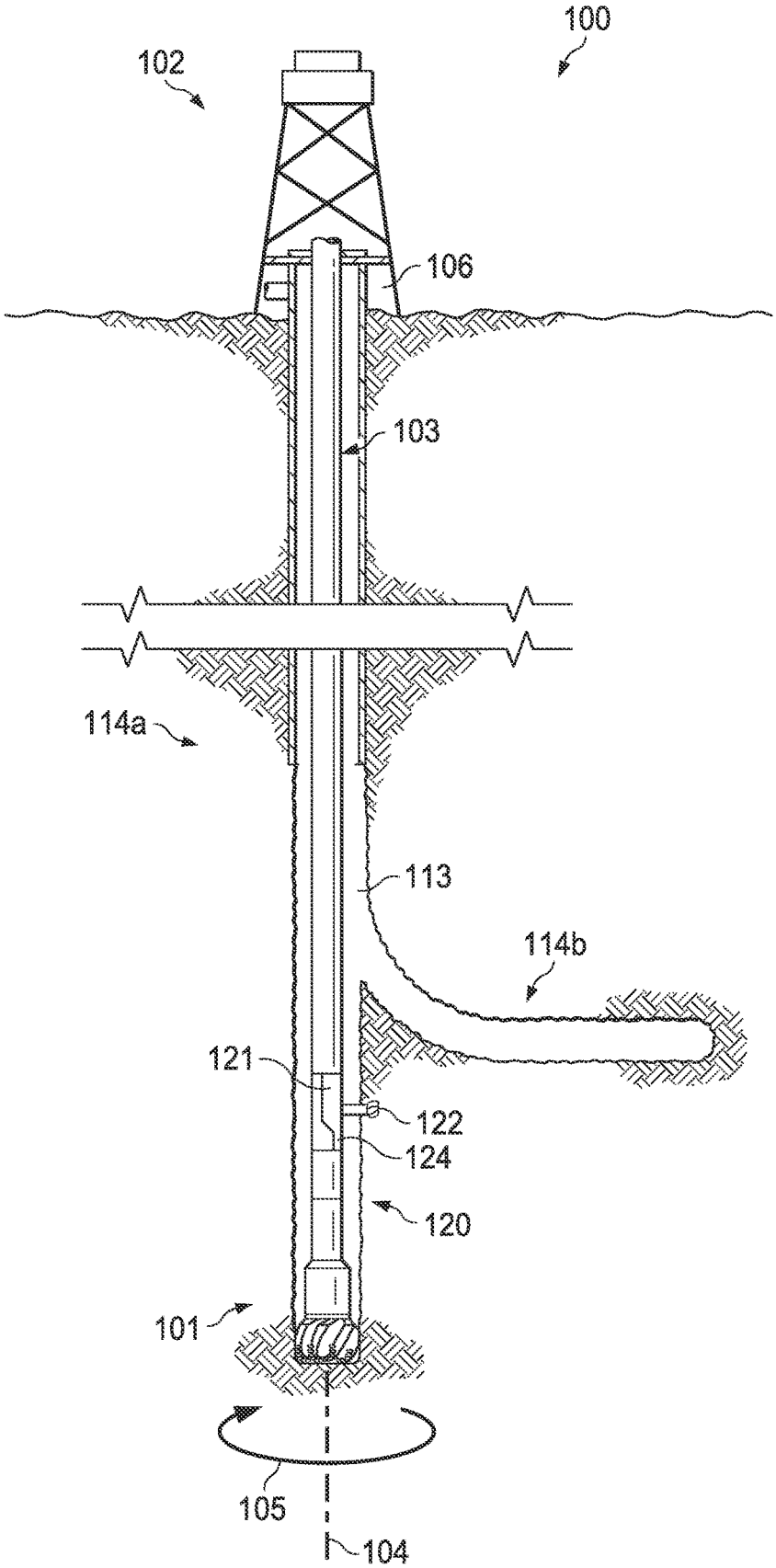
FIG. 1 illustrates an elevation view, with portions broken away, of a drilling system.

FIG. 1 is an elevation view, with portions broken away, of a drilling system. Drilling system 100 includes a well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a land drilling rig. However, equipment incorporating teachings of the present disclosure may be satisfactorily used with drilling equipment located on offshore platforms, drill ships, semi-submersibles, and/or drilling barges (not expressly shown).

Drilling system 100 also includes drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term directional drilling may be used to describe drilling a wellbore or portions of a wellbore that extend at a desired angle or angles relative to vertical. Such angles may be greater than normal variations associated with vertical wellbores. Direction drilling may include horizontal drilling.

BHA 120 may be formed from a wide variety of components configured to form wellbore 114. For example, BHA 120 may include, but is not limited to, drill bits (e.g., drill bit 101), coring bits, drill collars, rotary steering tools, directional drilling tools, downhole drilling motors, reamers, hole enlargers, or stabilizers. The number and types of components included in BHA 120 may depend on anticipated downhole drilling conditions and the type of wellbore that will be formed by drill string 103 and drill bit 101.

Drilling system 100 further includes drill bit 101 which may form wellbore 114. Drill bit 101 may rotate with respect to bit rotational axis 104 in a direction defined by directional arrow 105. Cutting action associated with forming wellbore 114 in a downhole formation may occur as the cutting elements on drill bit 101 engage with the bottom or downhole end of wellbore 114 in response to rotation of drill bit 101.

In some examples, BHA 120 may also include downhole tool 121 that includes coring bit 122 used to obtain a core sample from the sidewall of wellbore 114. Downhole tool 121 may be of a size such that drilling fluids, control lines, and other drilling materials and/or equipment used by drill bit 101 may be routed around downhole tool 121. The core sample may be obtained during a period when the drill string is not rotating. Coring bit 122 may be configured to move from a retracted position (not expressly shown), when not in use, to an extended position in order to perform a sidewall coring operation to remove a core sample from a formation surrounding wellbore 114. Coring bit 122 may have a central opening and may include one or more blades disposed outwardly from exterior portions of a bit body of coring bit 122. The bit body may be generally curved and the one or more blades may be any suitable type of projections extending outwardly from the bit body. The blades may include one or more cutting elements disposed outwardly from exterior portions of each blade. Coring bit 122 may have many different designs, configurations, and/or dimensions according to the particular application of coring bit 122.

In operation, coring bit 122 extends laterally through an opening in BHA 120. As coring bit 122 rotates and cuts into the formation, it may form a generally cylindrical core sample by cutting the formation around the central opening of coring bit 122 while leaving the portion of the formation in the central opening intact in order to obtain the core sample. After coring bit 122 obtains the core sample, the core sample may be stored in core holder 124. An end cap may be placed on core holder 124 to seal core holder 124 downhole such that the in-situ conditions of the core sample are preserved. For example, the fluids in and surrounding the core sample and the initial reservoir pressure and temperature conditions are maintained for analysis after core holder 124 is removed from BHA 120 at well surface 106. Core holder 124 may be described in more detail with respect to FIGS. 2 through 5.

Figure 2:
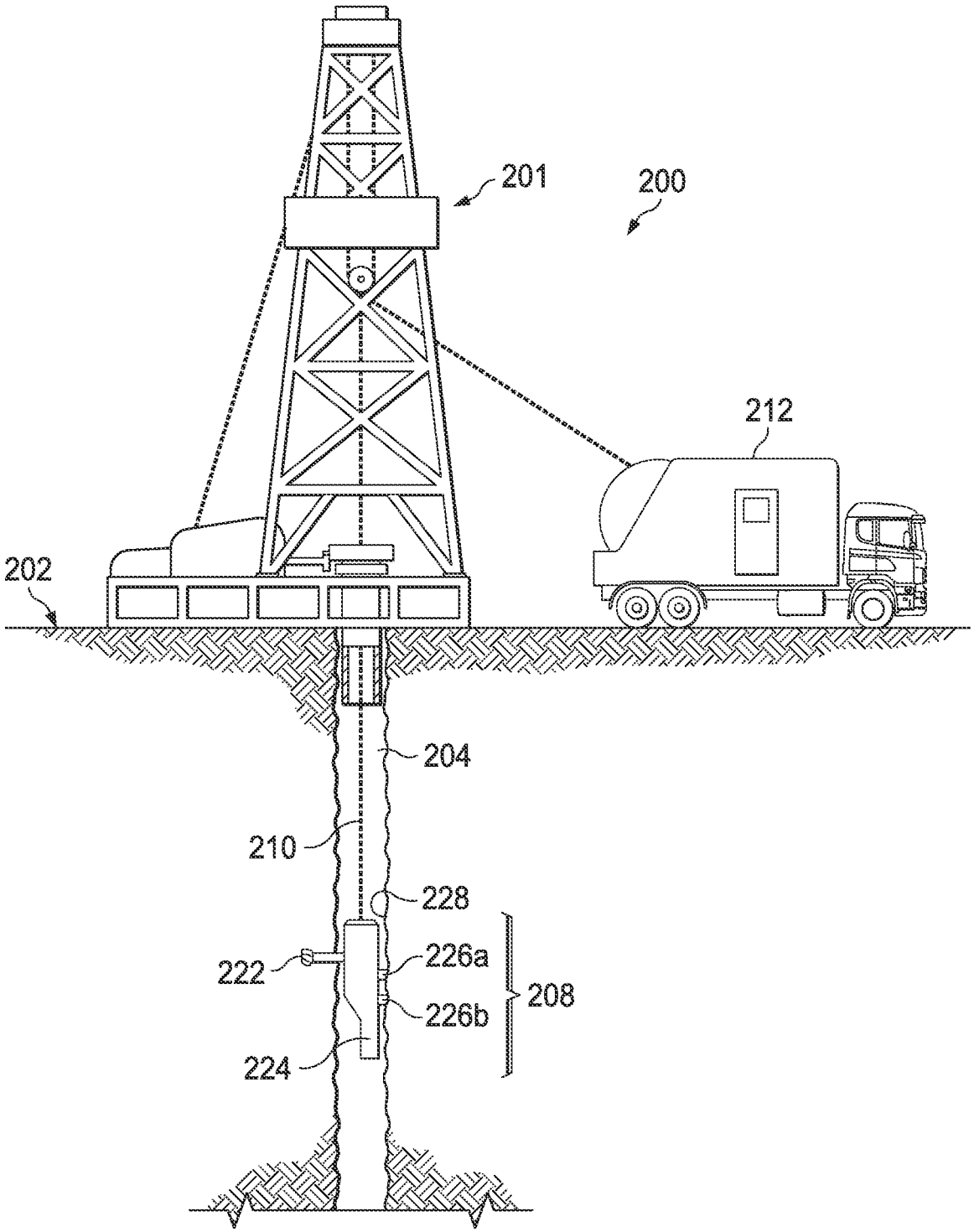
FIG. 2 illustrates an elevation view, with portions broken away, of a subterranean operations system used in an illustrative wellbore environment.

Core samples may also be obtained through the use of a wireline system. FIG. 2 illustrates an elevation view, with portions broken away, of a subterranean operations system used in an illustrative wellbore environment. Various types of equipment may be located at well surface 202. For example, well surface 202 may include rig 201 that may use conveyances or lines such as ropes, wires, lines, tubes, or cables to suspend a downhole tool in wellbore 204. Although FIG. 2 shows land-based equipment, downhole tools incorporating teachings of the present disclosure may be satisfactorily used with equipment located on offshore platforms, drill ships, semi-submersibles, and drilling barges (not expressly shown). Additionally, while wellbore 204 is shown as being a generally vertical wellbore, wellbore 204 may be any orientation including generally horizontal, multilateral, or directional.

Conveyance 210 may be any type of conveyance, such as a rope, cable, line, tube, or wire which may be suspended in wellbore 204. Conveyance 210 may be a single strand (e.g., a slickline) and/or a compound or composite line made of multiple strands woven or braided together (e.g., a wireline or coiled tubing). Conveyance 210 may be compound when a stronger line may be used to support downhole tool 208 or when multiple strands are required to carry different types of power, signals, and/or data to downhole tool 208. As one example of a compound line, conveyance 210 may include multiple fiber optic cables braided together and the cables may be coated with a protective coating.

Conveyance 210 may include one or more conductors for transporting power, data, and/or signals to wireline system 206 and/or telemetry data from downhole tool 208 to logging facility 212. Alternatively, conveyance 210 may lack a conductor and wireline system 206 may not be in communication with logging facility 212. Therefore wireline system 206 may include a control unit that includes memory, one or more batteries, and/or one or more processors for performing operations to control downhole tool 208 and for storing measurements. Logging facility 212 (shown in FIG. 2 as a truck, although it may be any other structure) may collect measurements from downhole tool 208, and may include computing facilities for controlling downhole tool 208, processing any measurements gathered by downhole tool 208, or storing measurements gathered by downhole tool 208. The computing facilities may be communicatively coupled to downhole tool 208 by way of conveyance 210. While logging facility 212 is shown in FIG. 2 as being onsite, logging facility 212 may be located remote from well surface 202 and wellbore 204.

Downhole tool 208 may include coring bit 222 used to obtain core samples from the sidewall of wellbore 204. Coring bit 222 may be configured to move from a retracted position (not expressly shown), when not in use, to an extended position in order to perform a sidewall coring operation to remove a core sample from a formation surrounding wellbore 204. Coring bit 222 may have a central opening and may include one or more blades disposed outwardly from exterior portions of a bit body of coring bit 222. The bit body may be generally curved and the one or more blades may be any suitable type of projections extending outwardly from the bit body. The blades may include one or more cutting elements disposed outwardly from exterior portions of each blade. Coring bit 222 may have many different designs, configurations, and/or dimensions according to the particular application of coring bit 222.

Once downhole tool 208 reaches a depth at which a core sample is to be obtained, coring bit 222 extends laterally through an opening in downhole tool 208. As coring bit 222 rotates and cuts into the formation, it may form a generally cylindrical core sample by cutting the formation around the central opening of coring bit 222 while leaving the portion of the formation in the central opening intact in order to obtain the core sample. After coring bit 222 obtains the core sample, the core sample may be stored in core holder 224. An end cap may be placed on core holder 224 to seal core holder 224 downhole such that the in-situ conditions of the core sample are preserved. For example, the fluids in and surrounding the core sample and the initial reservoir pressure and temperature conditions are maintained for analysis after core holder 124 is removed from downhole tool 208 at well surface 202. Core holder 224 may be described in more detail with respect to FIGS. 4 and 5.

When coring bit 222 is obtaining a core sample, the forces created by the cutting action of coring bit 222 may cause downhole tool 208 to move laterally in wellbore 204. Therefore, pistons 226*a* and 226*b* may extend laterally through an opening in downhole tool 208 and engage with sidewall 228 of wellbore 204 to maintain the lateral position of downhole tool 208. Pistons 226*a* and 226*b* may be retracted into downhole tool 208 when not in use to avoid restricting the vertical movement of downhole tool 208.

Figure 3A:
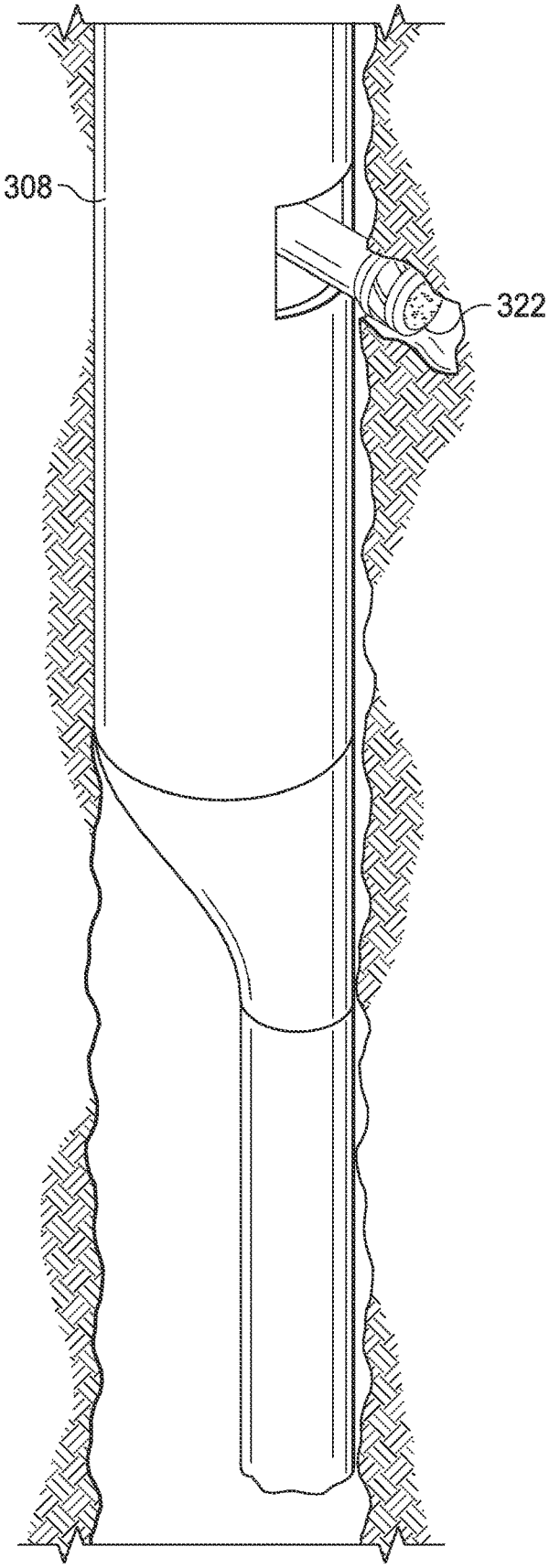
FIGS. 3A-3E illustrate the process by which a core sample is captured and stored in a core holder.

FIGS. 3A-3E illustrate the process by which a core sample is captured and stored in a core holder. FIG. 3A illustrates coring bit 322 extending laterally from downhole tool 308. Downhole tool 308 and coring bit 322 may be similar to downhole tool 208 and coring bit 222 shown in FIG. 2. Coring bit 322 may capture core sample 338 (not expressly shown in FIG. 3A) from a formation surrounding a wellbore into which downhole tool 308 is suspended. Coring bit 322 may have a hollow interior into which core sample 338 is captured during the sidewall coring operation.

Figure 3B:
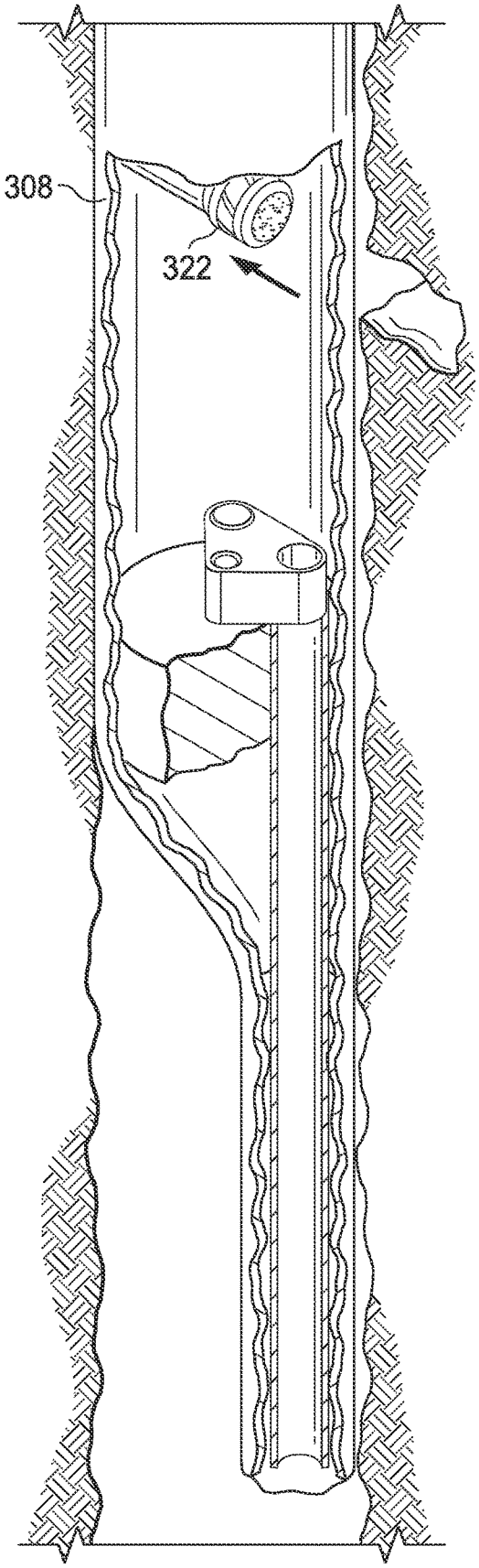

Once core sample 338 has been captured from the formation, coring bit 322 may retract laterally into downhole tool 308. FIG. 3B illustrates a perspective view of downhole tool 308 with portions broken away to show the position of coring bit 322 after core sample 338 (not expressly shown in FIG. 3B) has been captured. In this position, core sample 338 may be temporarily stored in the interior of coring bit 322.

Figure 3C:
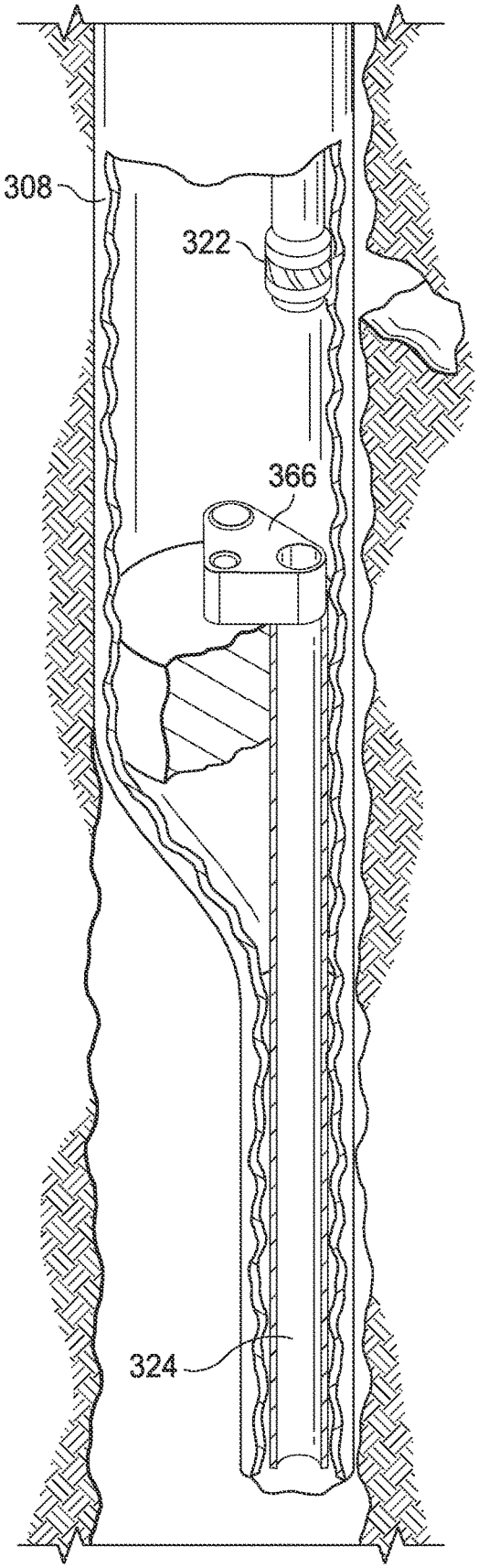

Coring bit 322 may then rotate vertically to deposit core sample 338 into core holder 324. FIG. 3C illustrates a perspective view of downhole tool 308 with portions broken away to show coring bit 322 after rotating to a vertical position. Core sample 338 (not expressly shown in FIG. 3C) may still be stored in the interior of coring bit 322. During rotation, coring bit 322 may be vertically aligned with core holder 324.

Figure 3D:
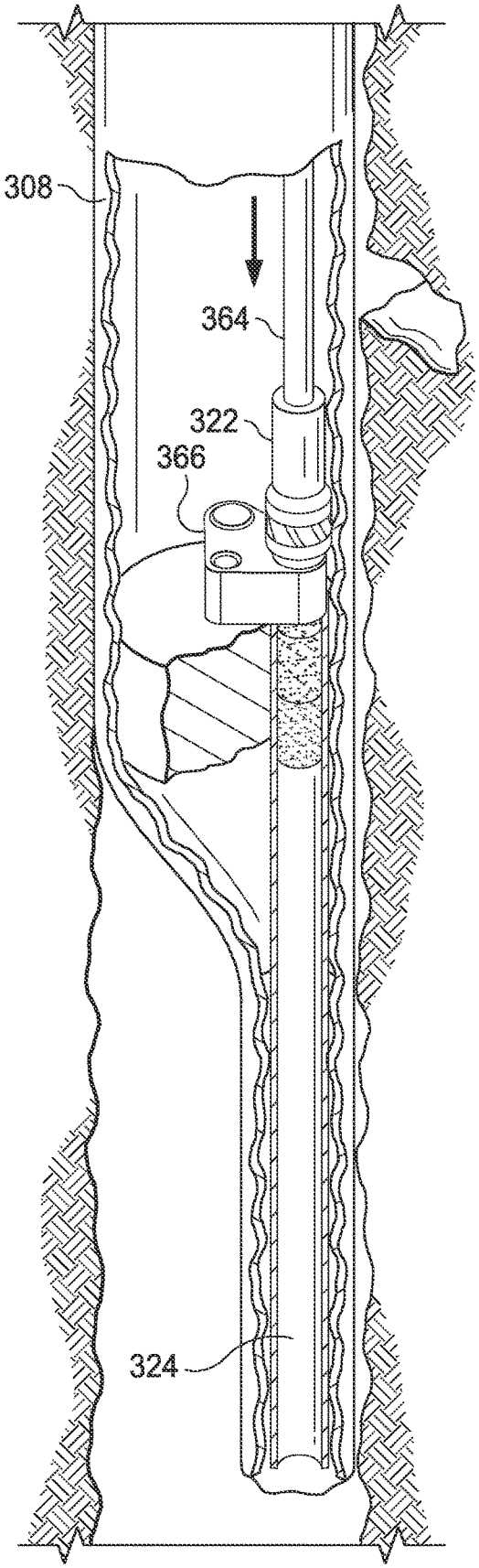

Once coring bit 322 is aligned with core holder 324, core sample 338 may be deposited into core holder 324. FIG. 3D illustrates a perspective view of downhole tool 308 with portions broken away to show core sample 338 exiting the interior of coring bit 322. Plunger 364 may extend to push core sample 338 from the interior of coring bit 322 and into core holder 324.

Figure 3E:
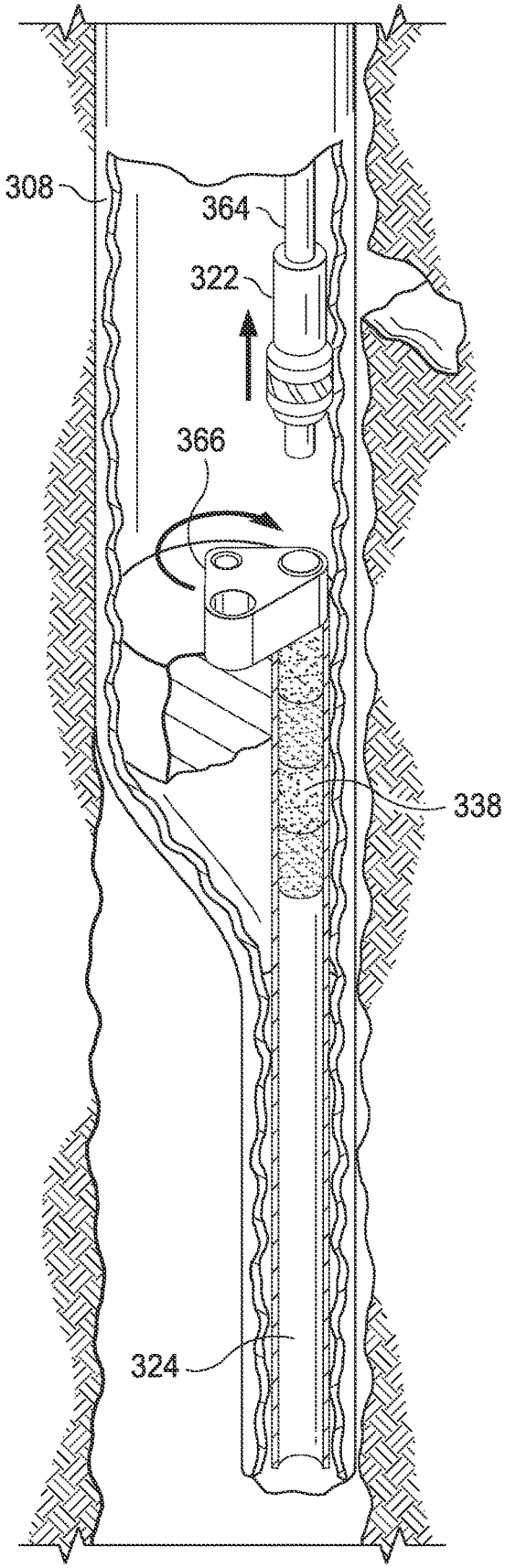

After core sample 338 is deposited in core holder 324, coring bit 322 may return to a horizontal position and core holder 324 may be sealed. FIG. 3E illustrates a perspective view of downhole tool 308 with portions broken away to show core sample 338 sealed in core holder 324. After core sample 338 is deposited in core holder 324, coring bit 322 may rotate back to a horizontal position. Cap holder 366 may then rotate such that end cap 334 is aligned with the end of core holder 324. Plunger 364 may extend to push end cap 334 from cap holder 366 into core holder 324 to seal core holder 324 such that formation fluids and/or gases captured in core holder 324 along with core sample 338 cannot exit core holder 324.

Figure 4:
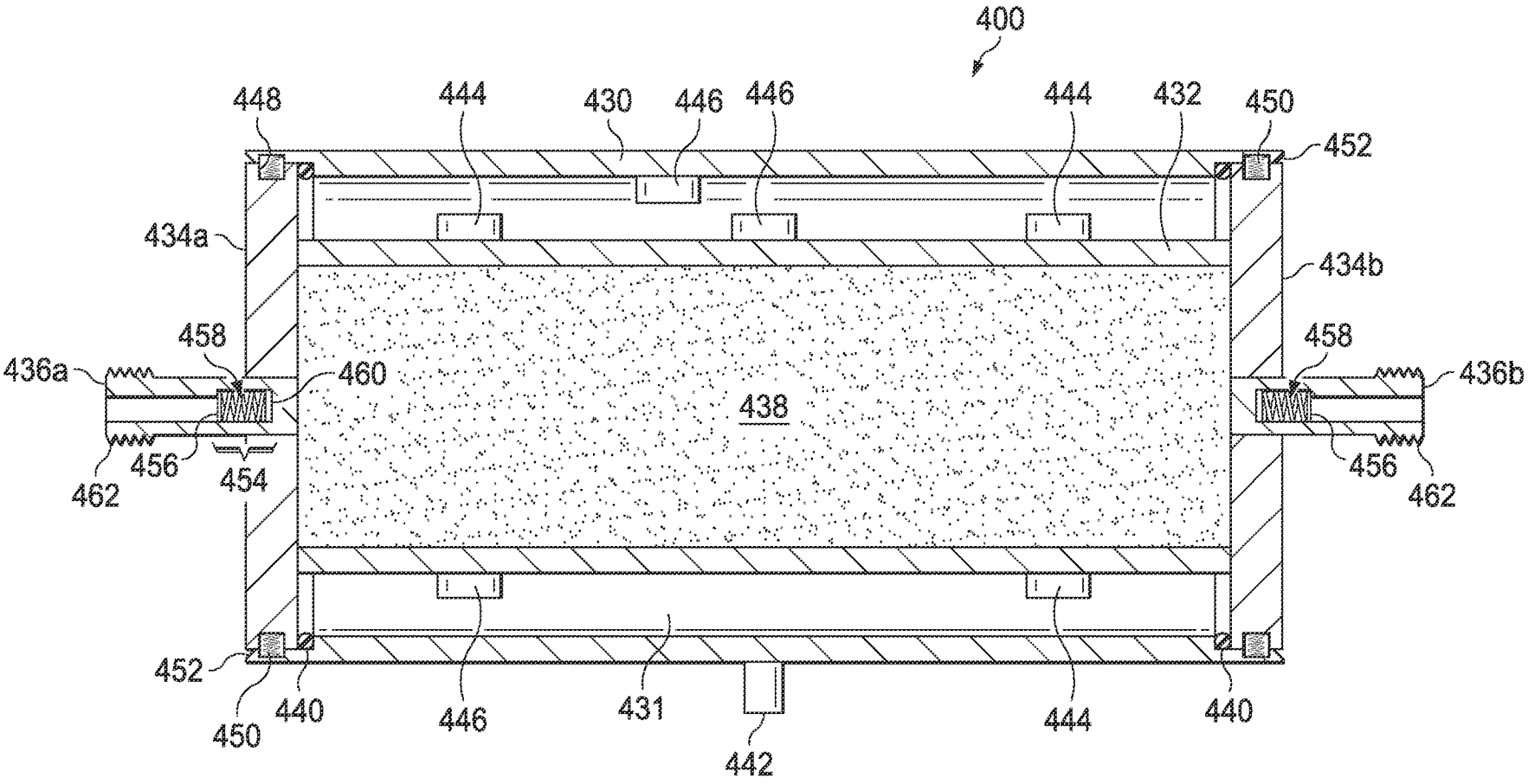
FIG. 4 illustrates a cross-sectional view of a core holder.

FIG. 4 illustrates a cross-sectional view of a core holder. Core holder 400 may be similar to core holders 124 and 224 respectively shown in FIGS. 1 and 2 and may include outer body 430, internal sleeve 432, end caps 434*a* and 434*b*, and ports 436*a-c*. Core holder 400 may enclose core sample 438 after core sample 438 is obtained from a subterranean formation by a coring bit such as coring bit 122 or coring bit 222 as respectively shown in FIGS. 1 and 2. End caps 434*a* and 434*b* may seal core holder 400 to preserve the in-situ conditions of core sample 438 and allow core sample 438 to be tested without removing core sample 438 from core holder 400 or exposing core sample 438 to the environment outside the wellbore.

Outer body 430 may have a rigid, generally cylindrical shape. Outer body 430 may be made from any suitable material that is x-ray transparent and can withstand the conditions in the wellbore, including titanium, carbon fiber, aluminum, or any combination thereof. Outer body 430 may be any suitable size based on the requirements of the subterranean operation and the testing that is performed on core sample 438. For example, outer body 430 may be sized to correspond with the size (e.g., length and diameter) of core sample 438. The size of core sample 438 may be based on the configuration of the coring bit. In some examples, outer body 430 may be larger than core sample 438 to obtain and store additional reservoir fluids from the formation surrounding the area from which core sample 438 is cut. In other embodiments, outer body 430 may be sized such that it is compatible with the testing equipment that is used to test core sample 438. For example, outer body 430 may be sized such that it may be inserted into a piece of testing equipment.

Internal sleeve 432 may have a generally cylindrical shape and may be made of a flexible material, such as an elastomeric material. The elastomeric material may be formed of compounds including, but not limited to, natural rubber, nitrile rubber, hydrogenated nitrile, urethane, polyurethane, fluorocarbon, perfluorocarbon, propylene, neoprene, hydrin, etc. In some embodiments, internal sleeve 432 may be a Hassler sleeve. Internal sleeve 432 may have a similar size as outer body 430 such that internal sleeve 432 fits inside outer body 430 and extends along the length of outer body 430.

Outer body 430 may form internal chamber 431 and end caps 434 may be coupled to the ends of outer body 430 to seal internal chamber 431. End caps 434 may be made of any suitable material that is x-ray transparent and can withstand the conditions in the wellbore such as titanium, carbon fiber, aluminum, or any combination thereof. In some examples, end cap 434*a* and outer body 430 may be manufactured such that outer body 430 and end cap 434*a* are formed as a single component. In other examples, end caps 434*a* and 434*b* may be coupled to outer body 430.

End cap 434*a* may be coupled to outer body 430 prior to the subterranean operation. For example, end cap 434*a* may be coupled to outer body 430 before core holder 400 is placed in a downhole tool prior to the drill string or wireline system being deployed into the wellbore. End cap 434*a* is coupled to outer body 430 to create internal chamber 431 in which core sample 438 may be stored. For example, end cap 434*a* may be welded, brazed, threaded, or coupled via an interference or press fit.

End cap 434*b* may be coupled to outer body 430 downhole after core sample 438 has been stored in core holder 400. For example, end cap 434*b* may be coupled to outer body 430 by threads or coupled to outer body 430 by a press fit or an interference fit. The coupling of end cap 434*b* to outer body 430 seals internal chamber 431 to preserve the downhole properties of core sample 438 for later analysis. For example, prior to cutting core sample 438 from a formation with a coring bit, such as coring bit 122 shown in FIG. 1 or coring bit 222 shown in FIG. 2, end cap 434*b* may be in an open position where end cap 434*b* is uncoupled from outer body 430. Core sample 438 may then be stored in outer body 430 and internal sleeve 432 during the coring operation. After core sample 438 has been cut from the formation, stored in outer body 430 and internal sleeve 432, and the coring operation is complete, end cap 434*b* may be positioned in a closed position where end cap 434*b* is coupled to an end of outer body 430 to seal internal chamber 431. The coupling is accomplished through the use of recessed surface 448 located on the inner lip of outer body 430 and snap-ring 450 located along the outer surface of end caps 434*a* and 434*b*. Snap-ring 450 may also be a series of collets. When end caps 434*a* and 434*b* are placed in contact with outer body 430, force is applied and snap-ring or collets 450 are compressed on beveled end 452 of outer body 430.

As further force is applied to end caps 434*a* and 434*b*, the force causes end caps 434*a* and 434*b* to move into the recess on the core body 430. When end caps 434*a* and 434*b* enter outer body 430 sufficiently such that snap-ring or collets 450 reach recess 448 in outer body 430, snap-ring or collets 450 are allowed to expand, locking endcaps 434*a* and 434*b* in place.

End caps 434*a* and 434*b* may also include sealing element 440 to seal the junction between end caps 434*a* and 434*b* and outer body 430. Sealing element 440 may be any suitable sealing mechanism including an O-ring, a sealing disc, or an elastomer sleeve. While only one sealing element 440 is shown in FIG. 3, end caps 434*a* and 434*b* may include any number of sealing elements 440.

Once core sample 438 is sealed inside core holder 400 and core holder 400 is returned to the surface of the well site, core holder 400 is removed from the downhole tool and subjected to testing to determine the properties of core sample 438 and the formation and surrounding reservoir from which core sample 438 was obtained. Therefore, core holder 430 includes a variety of components that facilitate testing core sample 438 while core sample 438 is stored in core holder 400 including ports 436, valves 442, strain gauges 444, and/or sensors 446. Ports 436 may be placed in outer body 430 and/or in end caps 434*a* and 434*b* to allow testing of core sample 438 after the coring operation. Core holder 400 may include at least one inlet port and at least one outlet port located at any position on core holder 400. Ports 436 may be sized to be compatible with the testing equipment with which core holder 400 is to be used.

Ports 436*a* and 436*b* may include sealing assembly 454 that is initially closed during the coring operation while the core is retrieved. Sealing assembly 454 may include valve seal 456, spring 458, and perforated disc 460. After core holder 400 is returned to the surface and sent to a laboratory for analysis, sealing assembly 454 may be opened and connected to fluid sampling, measurement and analytical equipment in the laboratory. The laboratory equipment may include a specialized connector including a spear-type device to force valve seal 456 open and hold it open during testing operations. Ports 436*a* and 436 may additionally include threads 462 to facilitate connection to testing equipment in the laboratory.

One or more valves 442 may be placed on outer body 430 to regulate, direct, or control the flow of fluids and/or gases into or out of core holder 400 to apply confining pressure between outer body 430 and inner sleeve 432, resulting in pressure being applied to core sample 438. Valve 442 may be any suitable valve for this purpose, such as a ball valve, check valve, choke valve, or globe valve. Valve 442 may be sized to be compatible with the testing equipment with which core holder 400 is to be used and/or the size of core holder 400. For example, a larger core holder 400 may contain a larger amount of fluids and/or gases and may require a larger valve 442 to allow a greater flow rate of fluids and/or gases into or out of core holder 400 during testing. The use of valve 442 may allow confining pressure to be applied to the outside perimeter of core sample 438 such that fluids are allowed to exit core sample 438 through ports 436*a* and/or ports 436*b* at the ends of core sample 438. The confining pressure applied to the outside perimeter of core sample 438 may prevent fluids from exiting core sample 438 between core sample 438 and internal sleeve 432. While valve 442 is shown in FIG. 3 as being in the center of core holder 400, valve 442 may be placed at any location on core holder 400. For example, the location of valve 442 may be selected so as not to impede imaging of core sample 438.

Core holder 400 may additionally include strain gauges 444 located on internal sleeve 432. Strain gauges 444 may be used to monitor and/or record the pressure, mechanical deformation, and stresses applied to core sample 438 during testing. Strain gauges 444 may be any suitable type of strain gauge capable of measuring small deformations, including a foil strain gauge, a mechanical strain gauge, or a capacitive strain gauge. Strain gauges 444 may be located at any position on internal sleeve 432 and may be oriented such that the stresses and mechanical deformation of core sample 438 may be recorded in any direction. For example, two strain gauges 444 may be oriented perpendicular to one another to record deformation in both the axial and lateral directions. As another example, a fiber optic coil may be wrapped around internal sleeve 432 to monitor the strain continuously along the surface of internal sleeve 432. While three strain gauges 444 are shown in FIG. 3, core holder 400 may include any number of strain gauges 444. The ability to monitor the strain and deformation of internal sleeve 432 while pressure is released from core sample 438 enables the measurement of volume changes of core sample 438 during the pressure release. The volume change of core sample 438 may be used to determine the impact of pore pressure on the porosity within the core. For example, a loss of volume of core sample 438 during pressure depletion may correspond to compaction which may result in a loss of permeability within core sample 438.

Core holder 400 may further include any number of sensors 446 located on outer body 430 and/or internal sleeve 432. The sensors may include any suitable type of sensor that may be used to monitor core sample 438 during testing, including fiber optic sensors, acoustic sensors, pressure sensors, and/or temperature sensors. The sensors may provide additional data about core sample 438 such as the effect of temperature changes or the presence of natural cracks or fractures. Sensors 446 may be placed at any location on outer body 430 and/or internal sleeve 432.

During testing core holder 400 may be used with a variety of testing equipment. For example, core holder 400 may be placed in x-ray computed tomography (CT) equipment to produce a three-dimensional representation of core sample 438 and determine the in-situ properties of core sample 438. As another example, ports 436 and valve 442 may be connected to pressure tap monitoring and gas chromatography equipment. Valve 442 may be used to increase the pressure between outer body 430 and internal sleeve 432 which increases the pressure applied to core sample 438. The gas chromatography equipment may analyze fluids released from core sample 438 as the fluids flow from core sample 438 through ports 436*a* and/or 436*b*. In other examples, ports 436 may be connected to mass spectrophotometer equipment, flow monitoring equipment, pressure monitoring equipment, or any other suitable analysis equipment used to determine the properties of a core sample. For example, the pressure monitoring equipment may record the pressure decay of core sample 438 as the pressure is released from core holder 400.

As another example, flow testing may be performed by connecting one port 436*a* or 436*b* to a high pressure pump and the other port 436*a* or 436*b* to a gathering system. Confining pressure may be applied through valve 442 to prevent annular flow between the outer perimeter of core sample 438 and internal sleeve 432 during the testing process. The volume of fluid pumped from core sample 436, the volume and properties of fluid captured, and the differential pressure between the inlet port and outlet port may be measured and used to calculate the effective reservoir permeability. The flow tests can be performed before or after the other testing has been completed on core sample 438 based on the testing parameters.

The ability to test core sample 438 in core holder 400 without disturbing core sample 438 may provide more accurate analysis of core sample 438 using conventional core testing techniques. For example, a more accurate analysis of fluid volumes within core sample 438 and the reserve of the reservoir from which core sample 438 was obtained, as well as the composition and properties and properties of said fluids may be obtained as the fluids in core sample 438 are preserved for testing. As another example, as core sample 438 may be imaged without opening core holder 400, higher resolution imaging and measurement of core sample 438 under initial reservoir pressure conditions and at various stages of pressure depletion may be obtained to determine the impact of pressure on permeability and fluid transmissibility through core sample 438. As a further example, as the pressure and fluid release from core sample 438 is performed under controlled conditions, analysis of fluid transmissibility through desorption and matrix and fracture flow may be performed at different pressure conditions and enable the measurement of the time required for pressure equalization. As an even further example, valve 442 may be used to inject completion chemicals and/or fluids into core sample 438 to evaluate the impact of the chemicals and/or fluids on core sample 438 under in-situ conditions and/or at treatment pressures.

After the pressure has been released from core sample 438 and the fluids contained in and surrounding core sample 438 have been released from core holder 400, core sample 438 may be removed from core holder 400 and used for conventional core testing and analysis.

While core holder 400 is described as enclosing a single core sample 438, core holder 400 may be designed to enclose multiple core samples 438. The number of core samples 438 that may be enclosed in core holder 400 may vary based on the requirements of the subterranean operation, the requirements of the subsequent core testing, or the size of core holder 400.

Figure 5:
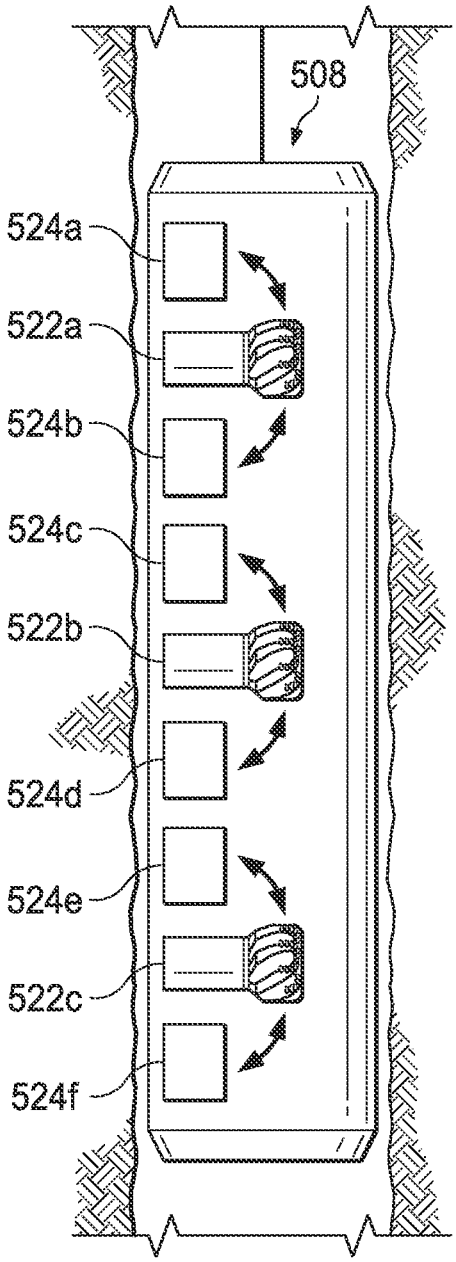
FIG. 5 illustrates a cross-sectional view of a downhole tool including multiple coring bits and core holders.

FIG. 5 illustrates a cross-sectional view of a downhole tool including multiple coring bits and core holders. In some cases, downhole tool 508 may include multiple coring bits 522 spaced axially along the length of downhole tool 508. Downhole tool 508 and coring bits 522 may be similar to downhole tool 208 and coring bit 222 described with reference to FIG. 2. The use of multiple coring bits 522 may provide for the collection of multiple core samples during a single subterranean operation. For example, downhole tool 508 may be lowered in a wellbore to a first depth where coring bit 522*a* may obtain a first core sample. Next, downhole tool 508 may be lowered to a second depth where coring bit 522*b* may obtain a second core sample. Finally, downhole tool 508 may be lowered to a third depth where coring bit 522*c* may obtain a third core sample, thus allowing multiple core samples to be obtained during a single downhole trip.

In some configurations, downhole tool 508 may include multiple core holders 524 for a single coring bit 522. Core holders 524 may be similar to core holder 400 shown in FIG. 4. Coring bit 522*a* may extend laterally from downhole tool 508 to obtain a core sample. Once the core sample is obtained, coring bit 522*a* may retract laterally into downhole tool 508 and rotate in one direction to deposit the core sample into core holder 524*a* or rotate in another direction to deposit the core sample into core holder 524*b*. While two core holders 524 are shown for each coring bit 522, downhole tool 508 may contain any number of core holders 524 for each coring bit 522.

The combination of multiple coring bits 522 on a single downhole tool 508 and multiple core holders 524 for each coring bit 522 may improve the efficiency of the subterranean operation and reduce the amount of time required to obtain sufficient core samples to analyze the properties of the reservoir. While the configuration shown in FIG. 5 is described with reference to a wireline system, as shown in FIG. 2, multiple coring bits 522 and core holders 524 may be implemented as part of a BHA coupled to a drill string, as shown in FIG. 1.

Embodiments Disclosed Herein Include:

A. A core holder including an outer body, an internal sleeve in the outer body, an end cap coupled to the outer body and operable to move from an open position to a closed position, and a plurality of ports located on at least one of the other body or the end cap.

B. A wireline system including a wireline and a downhole tool coupled to the wireline. The downhole tool includes a coring bit configured to capture a core sample from a formation and a core holder configured to store the core sample. The core holder includes an outer body, an internal sleeve in the outer body, an end cap coupled to the outer body and operable to move from an open position to a closed position, and a plurality of ports located on at least one of the other body or the end cap.

C. A drilling system including a drill string and a downhole tool coupled to the drill string. The downhole tool includes a coring bit configured to capture a core sample from a formation and a core holder configured to store the core sample. The core holder includes an outer body, an internal sleeve in the outer body, an end cap coupled to the outer body and operable to move from an open position to a closed position, and a plurality of ports located on at least one of the other body or the end cap.

Each of embodiments A, B, and C may have one or more of the following additional elements in any combination: Element 1: wherein the outer body is an x-ray transparent material. Element 2: further comprising a strain gauge disposed on the internal sleeve. Element 3: further comprising a sealing member positioned between the end cap and the outer body. Element 4: further comprising a sensor disposed in the outer body. Element 5: further comprising a valve on the outer body. Element 6: wherein the core holder has a size to accommodate more than one core sample. Element 7: wherein the plurality of ports are operable to connect to a core sample testing apparatus to allow reservoir characterization with a core sample in a simulated in-situ environment. Element 8: wherein the downhole tool further includes a plurality of coring bits positioned axially along the length of the downhole tool.

Although the present disclosure and its advantages have been described in detail, it should be understood that various changes, substitutions and alterations can be made herein without departing from the spirit and scope of the disclosure as defined by the following claims. It is intended that the present disclosure encompasses such changes and modifications as fall within the scope of the appended claims.

What is claimed is:

1. A core holder comprising:

an outer body formed of an x-ray transparent material, the x-ray transparent material comprises aluminum, titanium, or combinations thereof;

an internal sleeve in the outer body, the internal sleeve formed of a flexible material;

a sensor wrapped around the internal sleeve and configured to measure a strain of a core along the internal sleeve;

an end cap coupled to the outer body and operable to move from an open position to a closed position; and a plurality of ports located on at least one of the outer body or the end cap.

2. The core holder of claim 1, further comprising a strain gauge disposed on the internal sleeve.

3. The core holder of claim 1, further comprising a sealing member positioned between the end cap and the outer body.

4. The core holder of claim 1, further comprising a sensor disposed in the outer body.

5. The core holder of claim 1, further comprising a valve on the outer body.

6. The core holder of claim 1, wherein the core holder has a size to accommodate more than one core sample.

7. The core holder of claim 1, wherein the plurality of ports are operable to connect to a core sample testing apparatus to allow reservoir characterization with a core sample in a simulated in-situ environment.

8. A wireline system comprising:

a wireline; and a downhole tool coupled to the wireline, the downhole tool including:

a coring bit configured to capture a core sample from a formation; and a core holder configured to store the core sample, the core holder including:

an outer body formed of an x-ray transparent material, the x-ray transparent material comprises aluminum, titanium, or combinations thereof;

an internal sleeve in the outer body, the internal sleeve formed of a flexible material;

a sensor wrapped around the internal sleeve and configured to measure a strain of a core along the internal sleeve;

an end cap coupled to the outer body and operable to move from an open position to a closed position; and a plurality of ports located on at least one of the outer body or the end cap.

9. The wireline system of claim 8, wherein the core holder further includes a strain gauge disposed on the internal sleeve.

10. The wireline system of claim 8, wherein the core holder further includes a sealing member positioned between the end cap and the outer body.

11. The wireline system of claim 8, wherein the core holder further includes a sensor disposed in the outer body.

12. The wireline system of claim 8, wherein the core holder further includes a valve on the outer body.

13. The wireline system of claim 8, wherein the downhole tool further includes a plurality of coring bits positioned axially along the length of the downhole tool.

14. A drilling system comprising:

a drill string; and a downhole tool coupled to the drill string, the downhole tool including:

a coring bit configured to capture a core sample from a formation; and a core holder configured to store the core sample, the core holder including:

an outer body formed of an x-ray transparent material, the x-ray transparent material comprises aluminum, titanium, or combinations thereof;

an internal sleeve in the outer body, the internal sleeve formed of a flexible material;

a sensor wrapped around the internal sleeve and configured to measure a strain of a core along the internal sleeve;

an end cap coupled to the outer body and operable to move from an open position to a closed position; and a plurality of ports located on at least one of the outer body or the end cap.

15. The drilling system of claim 14, wherein the core holder further includes a strain gauge disposed on the internal sleeve.

16. The drilling system of claim 14, wherein the core holder further includes a sealing member positioned between the end cap and the outer body.

17. The drilling system of claim 14, wherein the core holder further includes a valve on the outer body.

* * * * *